US006267413B1

(12) United States Patent
Tran

(10) Patent No.: US 6,267,413 B1
(45) Date of Patent: Jul. 31, 2001

(54) DOUBLE ALBUM DISPLAY

(76) Inventor: Lam H. Tran, 7525 Oaktree Ave., Westminster, CA (US) 92683

( * ) Notice: Subject to any disclaimer, the term of this patent is extended or adjusted under 35 U.S.C. 154(b) by 0 days.

(21) Appl. No.: 09/660,231

(22) Filed: Sep. 12, 2000

(51) Int. Cl.[7] ..... B42D 3/00

(52) U.S. Cl. ..... 281/29; 281/22; 281/37; 281/45; 402/70; 402/73

(58) Field of Search ..... 281/15.1, 21.1, 281/22, 28, 29, 31, 37, 45; 402/70, 73

(56) References Cited

U.S. PATENT DOCUMENTS

| | | | | |
|---|---|---|---|---|
| 3,565,462 | * | 2/1971 | Gottlieb | 281/37 X |
| 4,637,631 | * | 1/1987 | Baer | 281/22 X |
| 5,713,684 | * | 2/1998 | Turelamo | 281/22 X |
| 6,003,901 | * | 12/1999 | Takemura | 281/22 X |

* cited by examiner

*Primary Examiner*—Willmon Fridie, Jr.
(74) *Attorney, Agent, or Firm*—Charles H. Thomas

(57) ABSTRACT

A double album of photograph display includes two mirror image portions located on opposite sides of a central web. Each mirror image portion is formed with a stiff, rectangular outer cover panel, an intermediate end panel, and a stiff inner cover panel. A packet of photograph mounting sheets is secured to the inside surface of the end panel of each mirror image portion of the base structure. Each of the photograph mounting sheets is capable of mounting at least one photograph. Preferably, pockets are provided in each photograph mounting sheet to accommodate a plurality of photographs in each mounting sheet. Photograph viewing windows are formed through the inner cover panels. Mutually engageable fasteners on each side of the central web may be provided to hold each packet within the confines of its associated outer and inner cover panel and the end panel to which the packet is secured. The album may be used as a freestanding structure whereby photographs in the viewing windows of the inner cover panels are displayed much in the manner of a freestanding frame for a plurality of photographs. When the fasteners are disengaged, the photograph mounting pages within both packets are accessible for viewing concurrently. The album may also be completely folded into a compact, generally rectangular book-like structure and stored in a book case, if desired.

17 Claims, 6 Drawing Sheets

DOUBLE ALBUM DISPLAY

BACKGROUND OF THE INVENTION

1. Field of the Invention

The present invention is a photograph album that is useful for both storing and displaying photographs.

2. Description of the Prior Art

Conventional photo albums are often constructed in the same manner as a book. That is, a photo album is typically comprised of a plurality or even a multiplicity of pages upon which photographs are mounted. The photograph mounting pages are bound together at a common binding edge between the front and back covers. The front and back covers are joined together by a spine and the binding edges of the photograph mounting pages are secured at the spine.

Conventional photo albums are quite adequate for storing photographs. However, conventional photo albums are not very useful for displaying photographs. If one attempts to stand a conventional photo album upright resting on the bottom edges of the front and back covers, the album is likely to fall over since the front and back covers are normally too close together to provide sufficient lateral stability for the album to stand upright. On the other hand, if one attempts to provide the necessary lateral stability by spreading the outside edges of the front and back covers apart from each other, the album is still unstable since the outside edges of the photograph mounting pages are then unsupported, and tend to buckle. The weight of the photograph mounting pages pulling against spine of the album is likely to cause the album to collapse by falling in a forward direction. A conventional photo album thereby makes a poor freestanding photograph display.

SUMMARY OF THE INVENTION

The present invention provides a photo album of unique construction that not only serves as an ideal means of storing photographs, but which also provides a self supporting, freestanding display for the photographs. A user is thereby not limited to the display of only one, two, or three photographs as with conventional freestanding picture frames. Quite to the contrary, a large number of photographs can be supported in an upright display arrangement utilizing the album display structure of the invention.

The photo album of the present invention performs not only the function of a conventional photo album, namely the storage of photographs, but also serves the function of a freestanding picture frame. Conventional picture frames may be formed with one, two, three, or even more frame panels within which photographs may be displayed on a piece of furniture, such as a desk, shelf, or buffet. However, conventional freestanding picture frames can hold only a few photographs at the most. The photo album of the present invention provides a stand up display that can exhibit a few photographs which are visible all the time, and which holds many more photographs which can be viewed at will. Alternatively, the photo album of the invention can be completely folded up and stored on a bookshelf or in a cabinet like a conventional photo album.

In one broad aspect the present invention may be considered to be a photograph display structure comprising: a flat rectangular base support having opposing, mutually parallel, laterally extending edges. The base support is folded longitudinally to form a plurality of stiff panels joined to each other in articulated fashion by linear hinge connections that extend between the opposing laterally extending edges. The plurality of panels include: a pair of outer cover panels disposed on opposing sides of a central spine, a pair of end panels each having a concealed surface and an exposed surface, and which are hinged to said outer cover panels, and a pair of inner cover panels hinged to the end panels. The photograph display structure also includes a pair of photo mounting packets, each packet being secured to the concealed surface of a separate one of the end panels. Each packet contains a plurality of photo mounting pages therewithin.

Preferably the end panels are formed as stiff, narrow, elongated strips disposed between the outer and inner cover panels. The spine is preferably formed as a stiff web disposed between the outer cover panels and having a width about equal to the combined widths of the pair of end panels. The outer and inner covers are preferably equal in height and are also preferably equal in width.

In a preferred embodiment of the invention the base support is formed of an opaque material and rectangular or oval windows are defined in the centers of the inside covers. Photographs are located between the inside cover panels and the photo mounting packets and display photographs are secured to the inside cover panels so that they are visible through the windows in the inside cover panels. The display photographs may be secured to the inside surface of the inner panels by any conventional means. For example, the photographs may be permanently secured in position by backing sheets glued to the inside surfaces of the inner cover panels. The photographs may also be removably positioned in the inner cover panel windows by conventional swivel tabs of the type used to secure pictures in frames.

Another preferred feature of the invention involves the use of interchangeable fasteners located on the inner cover panels and on the spine. When engaged, the releaseable and interengageable fasteners hold the packets trapped between the inner and outer cover panels in each of two mirror image portions of the display.

In another broad aspect the invention may be considered to be a double album photograph display structure comprising: a base support formed in a rectangular sheet with mutually parallel top and bottom edges and bifurcated into two mirror image portions by a central spine extending between the top and bottom edges. Each of the mirror image portions includes a stiff, rectangular outer cover panel connected to the spine at a hinged connection therewith. The hinged connections extend between the top and bottom edges. Each mirror image portion also includes an end panel narrower than the outer cover panels and joined thereto by a hinged connection that extends between the top and bottom edges. Each mirror image portion also includes a stiff, inner cover panel wider than the end panel and joined thereto by a hinged connection that extends between the top and bottom edges. In this way all of the panels of the base support are movable in articulated fashion relative to each other about the hinged connections. The photograph display structure also includes a pair of photograph packets. Each packet is mounted to a separate one of the end panels and each packet has a plurality of photograph mounting sheets therewithin for holding a plurality of photographs.

In still another aspect the invention may be considered to be a photograph display album comprising: a base support structure formed in a rectangular shape with mutually parallel, laterally extending top and bottom edges. The base structure is divided by longitudinally extending hinged connections that are perpendicular to and extend between the top and bottom edges. The structure thereby forms a central spine, a pair of flat, stiff outer cover panels, one on each side of the central spine, a pair of end panels each narrower than the outer cover panels and connected to a separate one of the outer cover panels, and a pair of flat, stiff inner cover panels. The inner cover panels are wider than and joined to a separate one of the end panels. The outer cover panels, the end panels and the inner cover panels are movable in rotation relative to each other in articulated fashion about the hinged connections therebetween. The display album is also comprised of a pair of photograph mounting packets. Each packet includes a plurality of photograph mounting sheets therewithin. Each of the photograph mounting packets is secured to a separate one of the end panels.

The invention may be described with greater clarity and particularity by reference to the accompanying drawings.

DESCRIPTION OF THE EMBODIMENT

Figure 1:
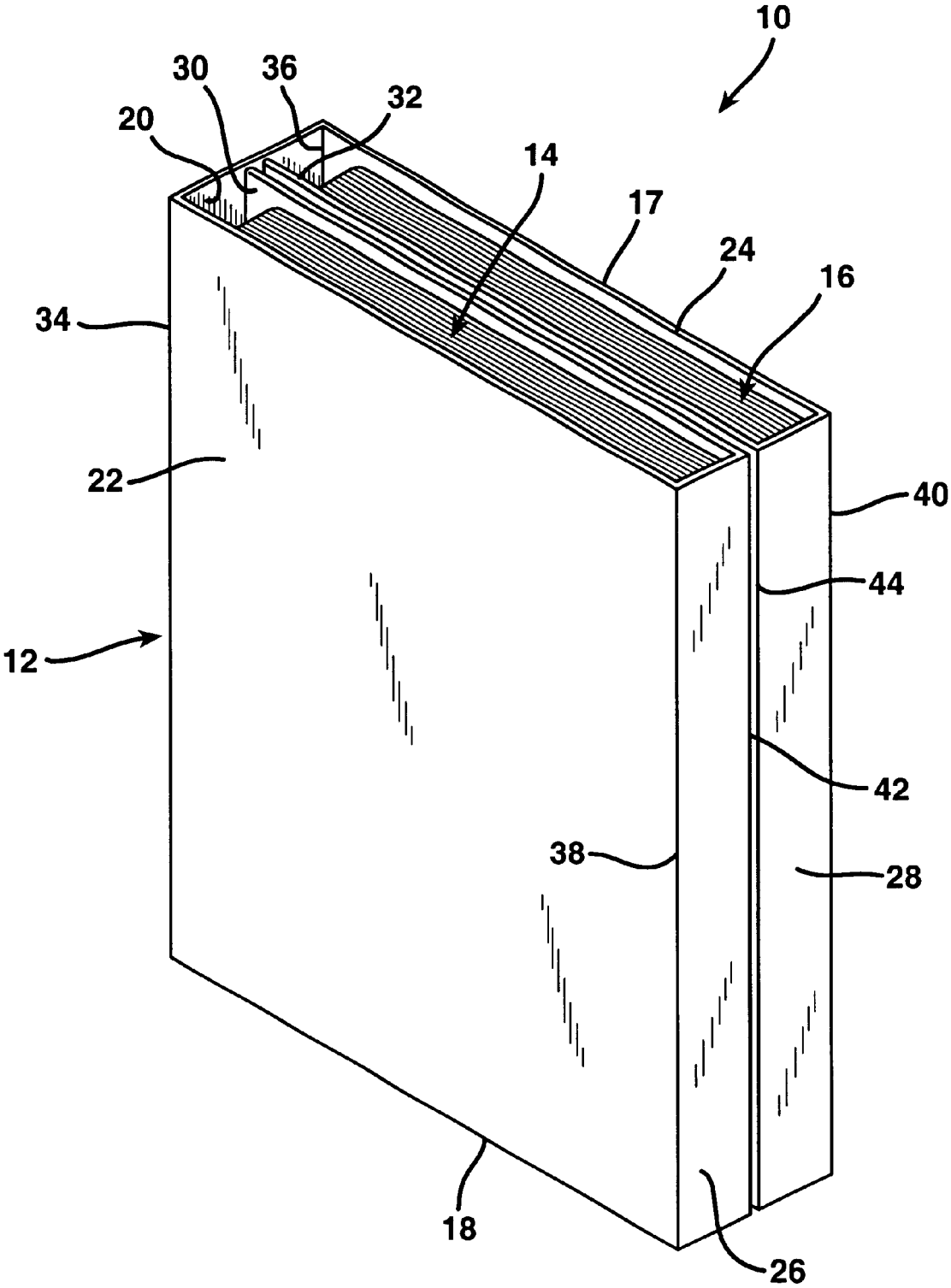
FIG. 1 is a perspective view of a preferred embodiment of a photograph display album according to the invention standing upright and fully closed.
Figure 2:
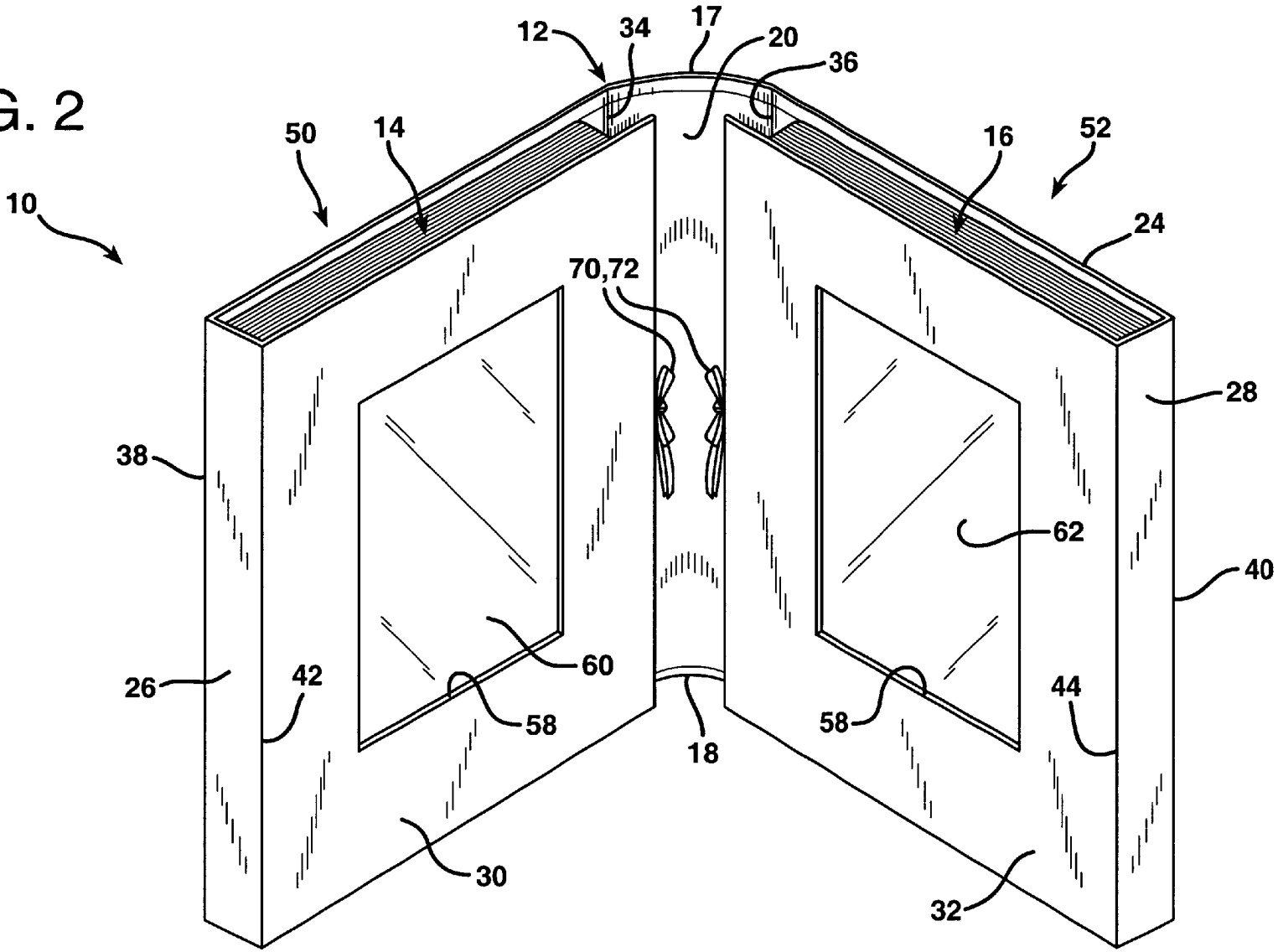
FIG. 2 is a perspective view of the photograph display album of FIG. 1 shown in a partially open condition.
Figure 4:
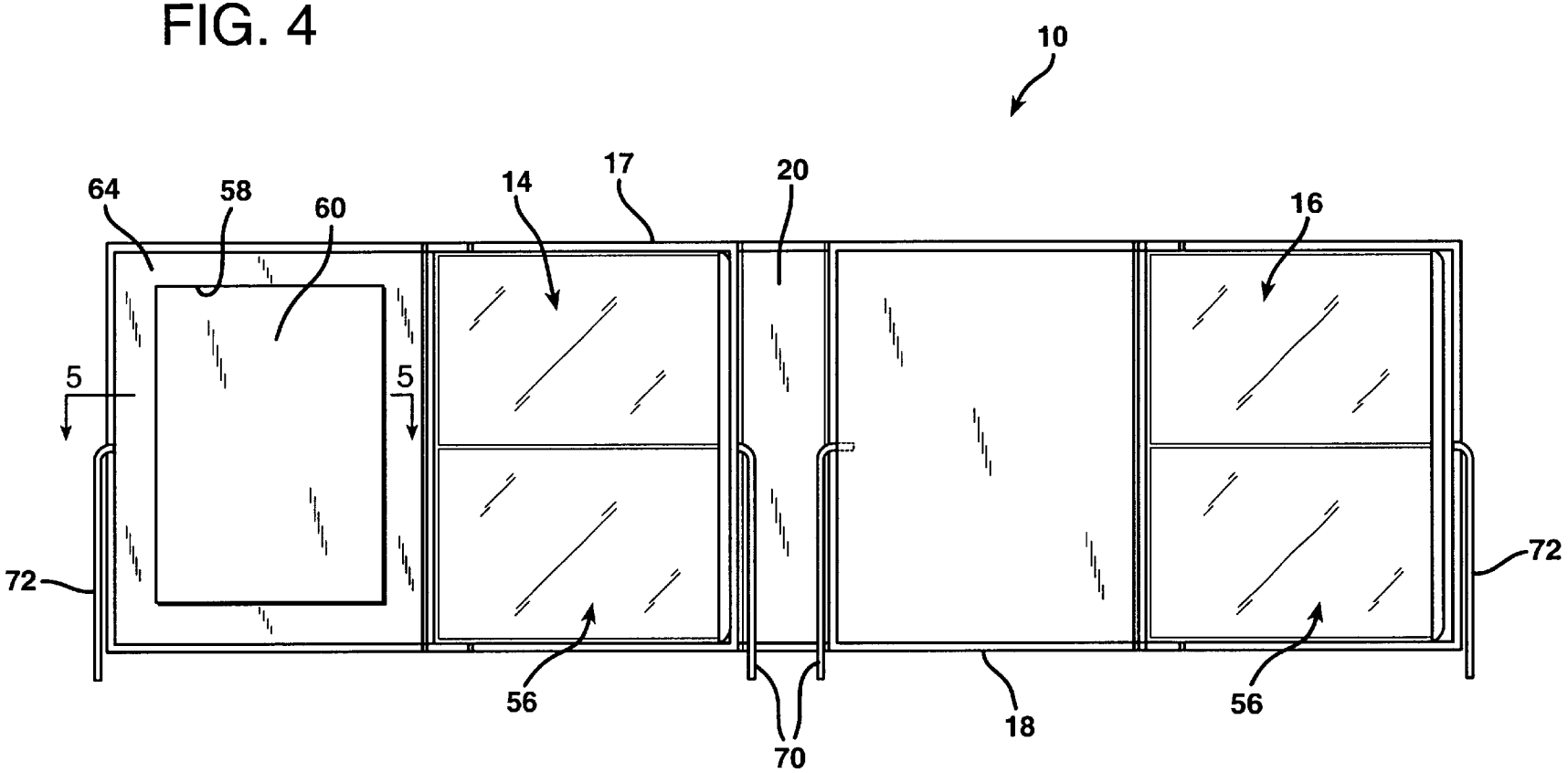
FIG. 4 is an elevational view showing the photograph display album of FIG. 1 in a fully opened condition.

FIGS. 1 and 2 illustrate a photograph display album 10 constructed according to the invention. The photograph display album 10 is comprised of a base support structure 12 and a pair of photograph mounting packets 14 and 16. The base support structure 12 is formed in an elongated, rectangular shape, as best illustrated in FIG. 4, and has mutually parallel, laterally extending top and bottom edges 17 and 18, respectfully. The base support structure 12 is formed with a central spine 20, a pair of flat, stiff, rectangular-shaped outer cover panels 22 and 24, a pair of stiff, narrow rectangular end panels 26 and 28, each narrower than the outer cover panels 22 and 24, and a pair of flat, stiff, rectangular-shaped inner cover panels 30 and 32. Each of the end panels 26 and 28 has a concealed side and an exposed side. The stiff panels 22, 24, 26, 28, 30, and 32 are delineated from each other by longitudinally extending hinged connections 34, 36, 38, 40, 42, and 44.

Figure 5:
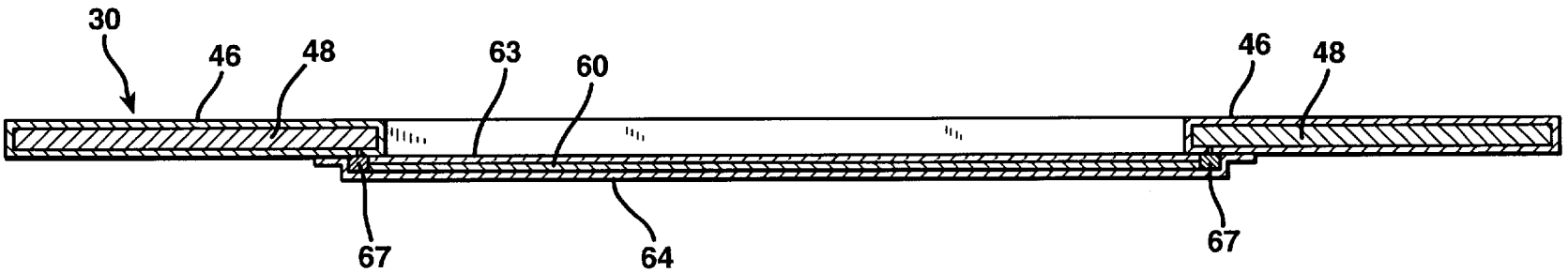
FIG. 5 is a sectional detail taken along the lines 5—5 in FIG. 4.

The base support structure 12 may be fabricated utilizing thin sheets 46 of fabric or plastic which encapsulate therewithin flat, rectangular core sections that provide a certain degree of rigidity to the stiff panels, such as the rectangular core 48 of the inner cover panel 30, shown in FIG. 5. The core sections 48 may be formed of fiber board or a stiff sheet of plastic.

As illustrated in FIG. 2, the base support 12 is bifurcated into two mirror image portions 50 and 52 by a spine which is formed as a flexible web 20 disposed between the outer cover panels 22 and 24. The web 20 is disposed between the outer cover panels 22 and 24 and has a width about equal to the combined width of the pair of end panels 26 and 28. The web 20 extends laterally between the outer panels 22 and 24. The longitudinal hinged connections 34 and 36 delineate the flexible web 20 from the adjoining stiff, rectangular outer cover panels 22 and 24. The outer cover panels 22 and 24 are thereby located one on each side of the flexible spine 20.

The end panels 26 and 28 are quite a bit narrower than the outer cover panels 22 and 24 and each have a width about half the width of the spine 20. Each of the end panels 26 and 28 is connected to a separate one of the outer cover panels by a hinged connection thereto. Specifically, the end panel 26 is connected to the outer cover panel 22 by the longitudinal hinge connection 38 that extends between the top edge 17 and the bottom edge 18 of the base support structure 12. The longitudinal hinge connection 40 connects and provides a delineation between the end panel 28 and the outer cover panel 24.

The inner cover panels 30 and 32 are likewise connected to and delineated from a separate one of the end panels. Specifically, the inner cover panel 30 is connected to the end panel 26 by a longitudinal hinged connection 42 while the inner cover panel 32 is connected to the end panel 28 by the longitudinal hinge connection 44. The inner cover panels 30 and 32 are equal in width to the width of the outer cover panels 22 and 24.

Each of the packets 14 and 16 is formed of a plurality of photograph mounting pages 56, two of which are visible in FIG. 4. The photograph mounting pages 56 are of conventional instruction. For example, each photograph mounting page 56 may be formed of two sheets of thin, plastic material disposed in face-to-face contact and having mutually congruent perimeters, portions of which are heat sealed together to define at least one pocket therebetween.

In the embodiment of the invention illustrated, two plies of thin polyethylene plastic form each of the photograph mounting pages 56 and are sealed along their top and bottom edges, and along a horizontal line of sealing midway between the top edge 17 and bottom edge 18 of the base support 12. Each of the photograph mounting pages 56 thereby forms an upper and lower pocket to respectively received two different photographs therewithin. The pockets are accessible for the insertion and removal of photographs through the unsealed portions of the parameters of the transparent plies of sheet material forming the mounting pages 56. The pockets defined by each of the photograph mounting pages 56 are thereby accessible from the edges of the mounting pages 56 remote from the end panels to which the mounting pages 56 are attached. Each packet 14 and 16 may contain, perhaps between about ten and twenty photograph mounting pages 56.

Each of the packets 14 and 16 is secured to a separate one of the end panels 26 and 28. More specifically, all of the photograph mounting pages 56 of the packet 14 are secured to the inwardly facing, concealed side of the end panel 26, while all of the photograph mounting pages 56 of the packet 16 are secured to the inwardly facing, concealed side of the end panel 28.

As illustrated in the drawing figures, the double album photograph display 10 of the invention may be utilized in a variety of different ways. In FIG. 1 the photograph display structure 10 is shown fully folded with the packets 14 and 16 respectively confined within each of the mirror image portions 50 and 52 of the base support 12. In this condition the photograph display structure 10 may be conveniently stored on a bookshelf or in a cabinet. FIG. 2 illustrates the photograph display structure with the mirror image portions 50 and 52 opened from each other.

Preferably, and as in the embodiment illustrated, each of the inner cover panels 30 and 32 is formed with a rectangular photograph viewing window 58 at its center. The photograph viewing window 58 is formed as a rectangular opening that extends entirely through the flat structure of each of the inner cover panels 30 and 32. As best illustrated in FIG. 5, photographs 60 and 62 are located between the inner cover panels and the two mounting packets. That is, a separate photograph 60 is located between the inner cover panel 30 and the packet 14 of photograph mounting pages 56 that is secured to the end panel 26 so that the photograph 60 in the inner cover panel 30 is visible through the window 58 therethrough. Similarly, the photograph 62 that is located between the inner, cover panel 32 and the packet 16 that is secured to the end panel 28 is visible through the viewing window 58 in the inner cover panel 32.

Thus, the photographs 60 and 62 may be chosen so as to be indicative of the types of photographs located within the packets 14 and 16, respectively. For example, the photograph 60 may be a choice photograph of one family member. Other photographs of that same family member may be located within the photograph packet 14. The photograph 62 may be chosen as one of the better photographs of a different family member. Other photographs of that same family member may be located within the packet 16.

FIG. 5 illustrates one manner of mounting the photographs 60 and 62. In the embodiment shown in FIG. 5 a rectangular backing sheet 64 is placed against the inside surface of the inner cover panel 30 once the photograph 60 has been positioned in the viewing window 58 thereof. A transparent PVC photo protector sheet 63 is located between the photograph 60 and the plastic or fabric overlay sheet 46. A spacer strip 67 is disposed about the periphery of the photograph pocket to ensure sufficient space for the photograph 60 to be inserted and removed from between the protector sheet 63 and the backing sheet 64. The photograph 60 resides in contact with the inside surface of the photo protector sheet 63. The backing sheet 64 is glued onto the inside surface of the inner cover member 30 to mount the photograph 60 in the viewing window 58 of the inner cover panel 30. Preferably there is an opening at one edge between the backing sheet 64 and the covering sheet 46 to allow insertion and removal of different photographs.

Figure 5A:
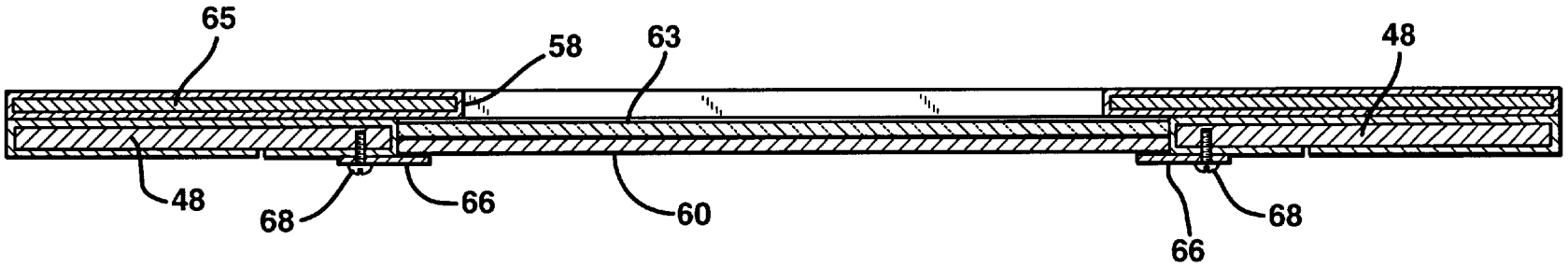
FIG. 5A is a sectional detail illustrating an alternative arrangement to that shown in FIG. 5 for mounting a photograph in an inner cover panel viewing window.
Figure 6:
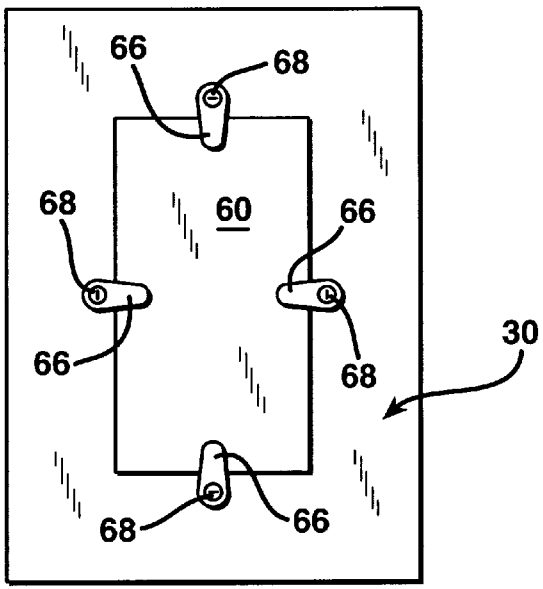
FIG. 6 is a rear elevational view of the photograph mounting system shown in FIG. 5A.

FIG. 5A illustrates an alternative mounting system in which the photograph 60 is removably mounted on the inside surface of the inner cover panel 30. As illustrated in that drawing figure, a front face sheet 65 has been glued on top of the outer face of the inner cover panel 30. Small, flat blocking tabs 66 are secured by screws 68 to the inside surface of the inner cover panel 30 near the center of each side of the rectangular window 58 therethrough. The screws 68 are engaged in the stiff fiber board or plastic structure of the core 48 of the inner cover panel 30. The locking tabs 66 can be rotated about the axes of the screws 68 so as to entrap the photograph 60. In this way the photograph 60 may be removably held in position with its border in contact with the inside surface of the inner cover panel 30, as illustrated in FIG. 5A and in FIG. 6. To remove the photograph 60, the locking tabs 66 are merely rotated out of registration with the viewing window 58, thus releasing the photograph 60. With this system, different photographs may be mounted in the viewing windows 58 of the inner cover panels 30 and 32 in place of the photographs 60 and 62.

When the double album photograph display structure 10 is utilized in the manner illustrated in FIG. 2, it is apparent that the width of the end panels 26 and 28 and the connection of the photograph packets 14 and 16 to the inside, concealed faces of the end panels 26 and 28 provides a very stable, freestanding photograph display structure. Because the photograph pages 56 are not attached to the web 20, but rather at locations remote from the web 20 and to the end panels 26 and 28, there is no tendency for the photographs to pull against the web 20 causing the structure to collapse. Quite to the contrary, the attachment of the photograph mounting pages 56 at locations remote from the flexible web 20 enhances the stability of the display album 10.

This stability may be enhanced even further by providing the photograph display album 10 with four engageable fasteners, such as the string ties that form the web fasteners 70 and inner cover fasteners 72 in each of the mirror image portions 50 and 52 of the base support structure 12. The web fastener string ties 70 are attached to the base structure 12 adjacent each of the outer cover panels 22 and 24 at their demarcations with the web 20. Corresponding inner cover fastener spring ties 72 are provided on each of the inner cover panels 30 and 32 remote from the respective hinge connections 42 and 44 that respectively connect the inner cover panels 30 and 32 to the end panels 26 and 28. As illustrated in FIG. 2, the sets of spring ties 70 and 72 in each of the mirror image portions 50 and 52 of the base support 12 may be engaged together to hold the photograph packets 14 and 16 entrapped between their respective inner and outer covers.

As illustrated in FIG. 2, when the spring tie fasteners 70 and 72 of the mirror image portion 50 of the base structure 12 are tied together the packet 14 is held entrapped between the inner cover panel 30 and the outer cover panel 22. Similarly, when the string ties 70 and 72 of the mirror image portion 52 of the base structure 12 are tied together, as illustrated in FIG. 2, the photograph packet 16 is entrapped between the inner cover panel 32 and the outer cover panel 24. The packets 14 and 16 are thereby respectively entrapped within stiff rigid confines on each side of the web 20 that forms the spine of the photograph display album 10.

Figure 3:
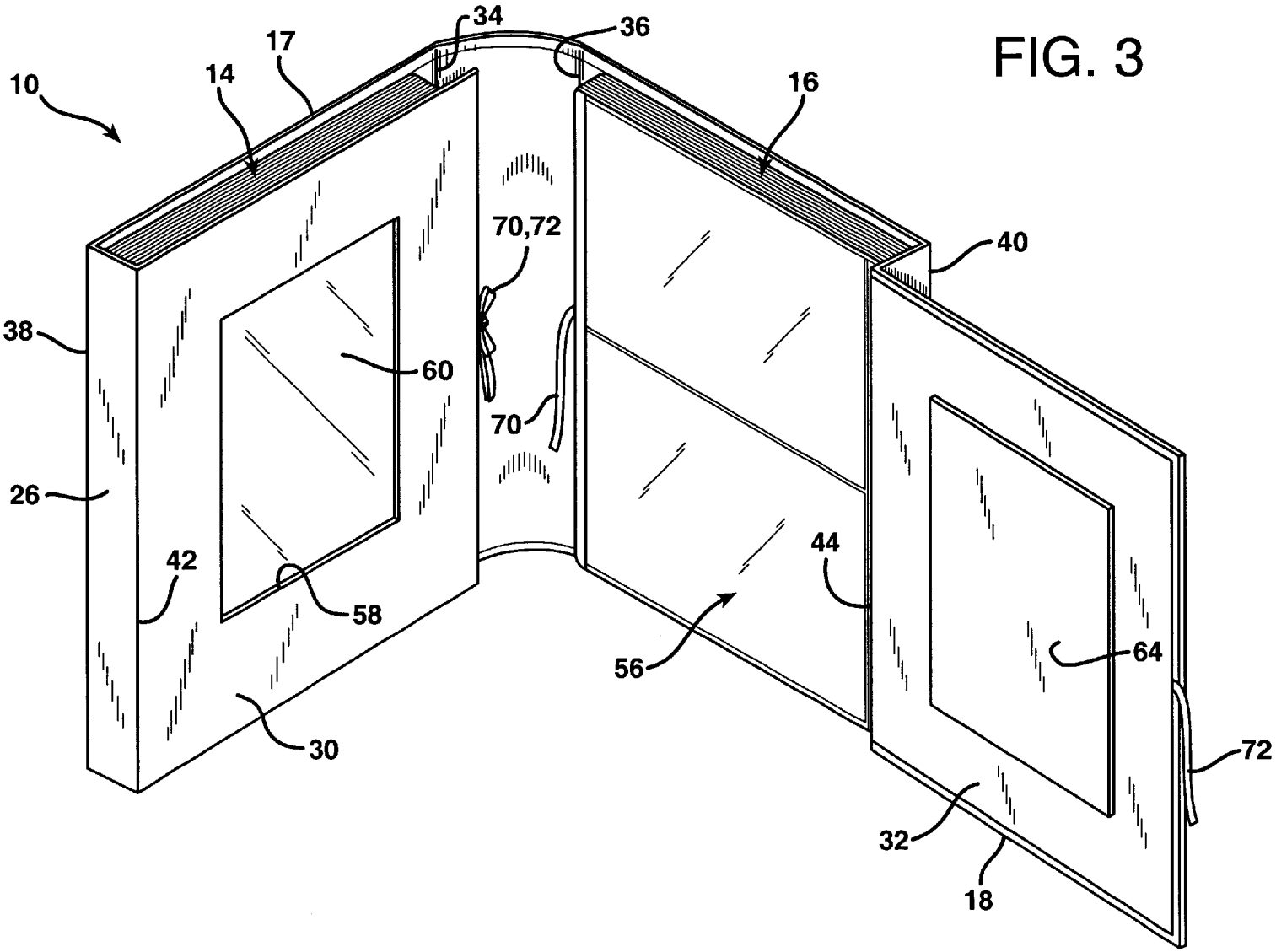
FIG. 3 is a perspective view of the photograph display album of FIG. 1 shown with one of the inner cover panels opened from the packet of photographs confined therewithin.

FIG. 3 illustrates the manner in which photographs on the photograph mounting pages 56 may be accessed for viewing. As shown in FIG. 3, the spring ties 70 and 72 in the portion 52 of base structure 12 may be untied and the inner cover panel 32 may be rotated outwardly relative to the end panel 28 about its hinge connection 44 therewith. This provides access to the mounting pages 56 of the portion 52 of the base structure 12. Since each of the mounting pages 56 in the portion 52 of the base structure 12 is attached to the inside surface of the end panel 28, the photograph mounting pages 56 may be rotated outwardly away from the outer cover panel 24, which is in a counterclockwise direction as viewed in FIG. 3. The photographs on each of the photograph mounting pages 56 may thereupon be viewed by a user.

The photograph display album 10 may also be laid out flat as illustrated in FIG. 4 so that photographs on the mounting pages 56 within each of the packets 14 and 16 may be viewed at the same time. As illustrated in that drawing figure, each of the photograph mounting pages 56 may be swung toward or away from its inner cover panel and toward or away from its outer cover panel. That is, the photograph mounting pages 56 in the packet 14 may be rotated about their connections to the end panel 26 toward or away from either the outer cover panel 22 or the inner cover panel 30. At the same time the photograph mounting pages 56 of the packet 16 may be rotated about their connections to the end panel 28 toward or away from either the outer cover panel 24 or the inner cover panel 32. It is thus apparent that when the double album photograph display 10 of the invention is deployed as illustrated in FIG. 4, photographs in the two packets 14 and 16 can be viewed simultaneously.

Undoubtedly, numerous variations and modifications of the invention will become readily apparent to those familiar with photograph albums. For example, many different materials may be utilized for both the base structure 12 and the photograph mounting pages 56. Accordingly, the scope of the invention should not be construed as limited to this specific embodiment depicted and described, but rather as defined in the claims appended hereto.

I claim:

1. A photograph display structure comprising:

a flat rectangular base support having opposing, mutually parallel, laterally extending edges and said base support is folded longitudinally to form a plurality of stiff panels joined to each other in articulated fashion by linear hinge connections that extend between said opposing laterally extending edges, wherein said plurality of panels include: a pair of outer cover panels disposed on opposing sides of a central spine, a pair of end panels, each having a concealed surface and an exposed surface, and which are hinged to said outer cover panels, and a pair of inner cover panels hinged to said end panels, and a pair of photo mounting packets, each packet being secured to said concealed surface of a separate one of said end panels and wherein each packet contains a plurality of photo mounting pages therewithin.

2. A photograph display structure according to claim 1 wherein said end panels are formed as stiff, elongated strips narrower in width than and disposed between said outer and inner cover panels.

3. A photograph display structure according to claim 1 wherein said spine is formed as a stiff web disposed between said outer cover panels and having a width about equal to the combined widths of said pair of end panels.

4. A photograph display structure according to claim 3 where said outer and inner covers are equal in height and are equal in width.

5. A photograph display structure according to claim 1 wherein said base support is formed of an opaque material and windows are defined in said inner cover panels.

6. A photograph display structure according to claim 5 further comprising display photographs located between said inner cover panels and said photo mounting packets and secured to said inner cover panels so that said display photographs are visible through said windows in said inner cover panels.

7. A photograph display structure according to claim 1 further comprising interengageable and releasable fasteners located on said inner cover panels and on said spine, whereby when engaged said releasable fasteners hold said packets entrapped between said inner and outer panels.

8. A photograph display structure according to claim 1 wherein said photo mounting pages of said packets are each comprised of a pair of transparent sheets having mutually congruent perimeters, portions of which are sealed together to define at least one pocket therebetween and portions of which are left unsealed, whereby said pockets are accessible for the insertion and removal of photographs through said unsealed portions of said perimeters of said transparent sheets.

9. A double album photograph display structure comprising:

a base support formed in a rectangular shape with mutually parallel top and bottom edges and bifurcated into two mirror image portions by a central spine expanding between said top and bottom edges, each of said mirror image portions including a stiff, rectangular outer cover panel connected to said spine at a hinged connection therewith that extends between said top and bottom edges, an end panel narrower than said outer cover panel and joined thereto by a hinged connection that extends between said top and bottom edges, and a stiff, inner cover panel wider than said end panel and joined thereto by a hinged connection that extends between said top and bottom edges, whereby all of said panels of said base support are movable in articulated fashion relative to each other about said hinged connections, and a pair of photograph packets, each packet being mounted to a separate one of said end panels and each packet having a plurality of photograph mounting sheets therewithin for holding a plurality of photographs.

10. A double album photograph display structure according to claim 9 wherein said spine is formed as a web that extends laterally between said outer panels and each of said end panels has a width equal to about one-half the width of said web at said spine.

11. A double album photograph display structure according to claim 10 wherein said end panels are stiff and rectangular in shape.

12. A double album photograph display structure according to claim 11 wherein said web is formed of a stiff material.

13. A double album photograph display structure according to claim 12 wherein said web is provided with web fasteners adjacent each of said outer cover panels, and said inner cover panels are provided with inner cover fasteners remote from said hinge connections to said end panels, and said web fasteners are engageable with said inner cover fasteners to hold said photograph packets entrapped between said inner and outer cover panels on each side of said spine.

14. A double album photograph display structure according to claim 9 wherein each of said inner cover panels is formed with a photograph viewing window defined completely therethrough.

15. A photograph display album comprising:

a base support structure formed in a rectangular shape with mutually parallel, laterally extending top and bottom edges and said base support structure is divided by longitudinally extending hinged connections that are perpendicular to and extend between said top and bottom edges, thereby forming a central spine, a pair of flat, stiff outer cover panels, one on each side of said central spine, a pair of end panels, each narrower than said outer cover panels and connected to a separate one of said outer cover panels, and a pair of flat, stiff inner cover panels, each wider than and joined to a separate one of said end panels, whereby said outer cover panels, said end panels and said inner cover panels are movable in rotation relative to each other in articulated fashion about said hinged connections therebetween, and a pair of photograph mounting packets, each packet including a plurality of photograph mounting sheets therewithin and each of said photograph mounting packets is secured to a separate one of said end panels.

16. A photograph display album according to claim 15 wherein said end panels are stiff and rectangular in shape and further comprising a web at said spine and said web has a width that is about equal to the combined widths of said end panels.

17. A photograph display album according to claim 15 further comprising photograph viewing windows defined in each of said inner cover panels.

* * * * *